US009129468B2

(12) United States Patent
Nulph

(10) Patent No.: US 9,129,468 B2
(45) Date of Patent: Sep. 8, 2015

(54) GAMING MACHINE AND METHOD FOR VALIDATING A VOUCHER

(75) Inventor: James L. Nulph, Broken Arrow, OK (US)

(73) Assignee: Video Gaming Technologies, Inc., Franklin, TN (US)

( * ) Notice: Subject to any disclaimer, the term of this patent is extended or adjusted under 35 U.S.C. 154(b) by 908 days.

(21) Appl. No.: 12/712,077

(22) Filed: Feb. 24, 2010

(65) Prior Publication Data

US 2010/0216543 A1 Aug. 26, 2010

Related U.S. Application Data

(60) Provisional application No. 61/155,817, filed on Feb. 26, 2009.

(51) Int. Cl.

| | |
|---|---|
| ***G06Q 99/00*** | (2006.01) |
| ***G07F 17/32*** | (2006.01) |
| *A63F 9/24* | (2006.01) |
| *G07F 17/00* | (2006.01) |

(52) U.S. Cl.

CPC ..... *G07F 17/32* (2013.01); *G07F 17/3248* (2013.01); *A63F 9/24* (2013.01); *G07F 17/00* (2013.01); *G07F 17/3244* (2013.01)

(58) Field of Classification Search

CPC ..... A63F 9/24; G07F 17/00; G07F 17/32; G07F 17/3244; G07F 17/3248

USPC ..... 463/25, 29; 705/50

See application file for complete search history.

(56) References Cited

U.S. PATENT DOCUMENTS

| | | | | |
|---|---|---|---|---|
| 5,290,033 | A | 3/1994 | Bittner et al. | |
| 6,874,681 | B1 | 4/2005 | Izawa et al. | |
| 6,935,951 | B2 | 8/2005 | Paulsen et al. | |
| 7,080,782 | B2 * | 7/2006 | Charrin | 235/451 |
| 7,222,852 | B2 | 5/2007 | Soltys et al. | |
| 7,316,615 | B2 | 1/2008 | Soltys et al. | |

(Continued)

FOREIGN PATENT DOCUMENTS

| | | |
|---|---|---|
| WO | WO 2006/052469 A2 | 5/2006 |
| WO | WO 2006/052469 A3 | 5/2006 |

OTHER PUBLICATIONS

International Preliminary Report on Patentability and Written Opinion mailed Sep. 9, 2011.

(Continued)

*Primary Examiner* — James D Nigh

(74) *Attorney, Agent, or Firm* — Armstrong Teasdale LLP

(57) ABSTRACT

A method of validation of a voucher in a gaming machine includes receiving the voucher in the gaming machine from a user. The voucher includes first coded indicia having first identification data and value data. The voucher also includes second coded indicia being generally non-viewable and having second identification data. The method also includes reading the first coded indicia and decoding the first coded indicia to determine the first identification data and the value data. The method further includes reading the second coded indicia and decoding the second coded indicia to determine the second identification data. An algorithm is executed with a controller using at least one of the first identification data, the second identification data, and the value data to generate algorithm data. The method also includes validating the authenticity of the voucher with the controller using at least the algorithm data to determine if the voucher is authentic.

15 Claims, 2 Drawing Sheets

(56) References Cited

U.S. PATENT DOCUMENTS

| | | | | |
|---|---|---|---|---|
| 7,346,184 | B1 | 3/2008 | Carr et al. | |
| 7,762,888 | B2 * | 7/2010 | Rowe | 463/29 |
| 7,988,550 | B2 * | 8/2011 | White | 463/25 |
| 8,137,181 | B2 * | 3/2012 | Bleich et al. | 463/20 |
| 8,463,711 | B2 * | 6/2013 | Cunningham et al. | 705/68 |
| 2004/0033095 | A1 | 2/2004 | Saffari et al. | |
| 2004/0053684 | A1 | 3/2004 | Chudd et al. | |
| 2004/0058728 | A1 * | 3/2004 | Fayter et al. | 463/25 |
| 2004/0110557 | A1 * | 6/2004 | Rowe | 463/25 |
| 2005/0006472 | A1 | 1/2005 | Verschuur et al. | |
| 2005/0020356 | A1 | 1/2005 | Cannon | |
| 2005/0107163 | A1 * | 5/2005 | Nguyen et al. | 463/42 |
| 2005/0137005 | A1 | 6/2005 | Soltys et al. | |
| 2005/0156318 | A1 | 7/2005 | Douglas | |
| 2005/0189416 | A1 * | 9/2005 | Charrin | 235/440 |
| 2005/0234834 | A1 * | 10/2005 | Taylor | 705/77 |
| 2006/0039733 | A1 | 2/2006 | Meyerhofer | |
| 2006/0154719 | A1 | 7/2006 | Okuniewicz | |
| 2007/0167223 | A1 * | 7/2007 | Bleich et al. | 463/25 |
| 2008/0039190 | A1 | 2/2008 | Walker et al. | |
| 2008/0085775 | A1 | 4/2008 | Kasai et al. | |
| 2008/0119258 | A1 | 5/2008 | Perez et al. | |
| 2008/0207307 | A1 * | 8/2008 | Cunningham, II et al. | 463/25 |
| 2009/0177539 | A1 | 7/2009 | Pham | |
| 2010/0004051 | A1 | 1/2010 | Walker et al. | |

OTHER PUBLICATIONS

International Search Report and Written Opinion, Opinion mailed Apr. 22, 2010.

* cited by examiner

FIG. 2
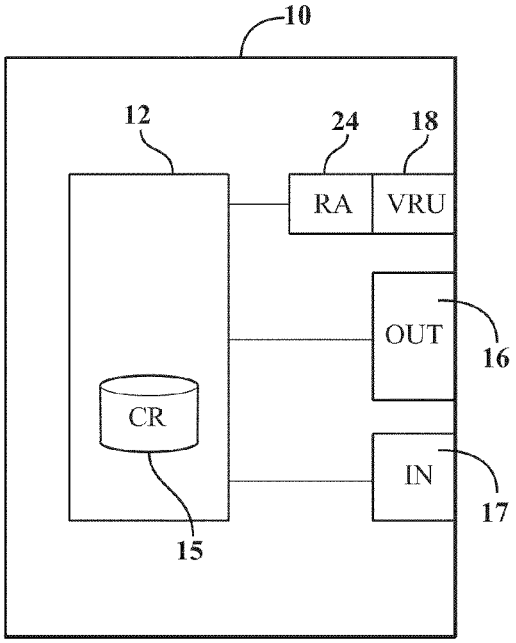
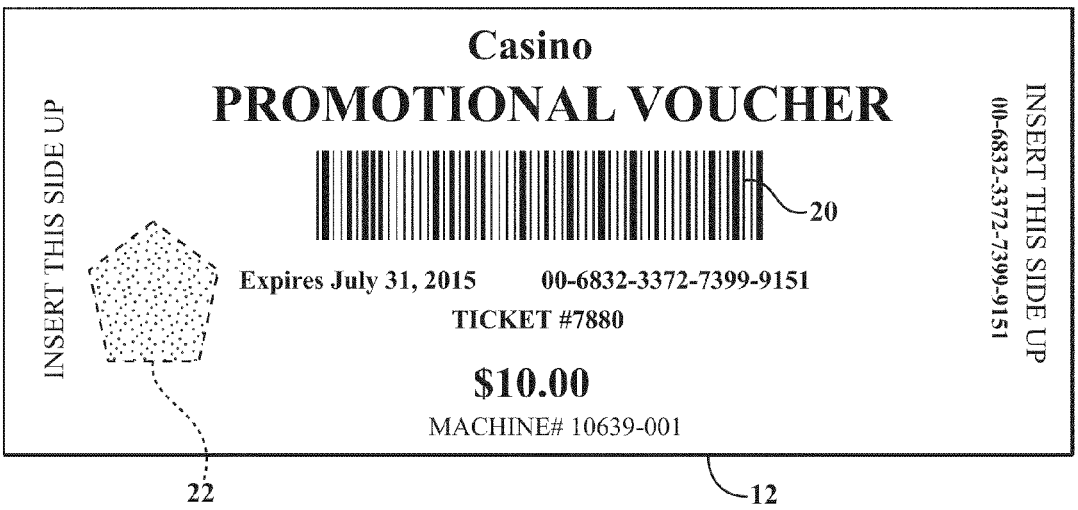
FIG. 3

GAMING MACHINE AND METHOD FOR VALIDATING A VOUCHER

CROSS REFERENCE TO RELATED APPLICATION

This application claims the benefit of provisional patent application No. 61/155,817, filed Feb. 26, 2009, which is hereby incorporated by reference.

BACKGROUND OF THE INVENTION

1. Field of the Invention

The invention relates generally to gaming machines and specifically for validating vouchers in gaming machines.

2. Description of the Related Art

Gaming machines are ubiquitous in casinos and other gambling facilities. These machines, often referred to as slot machines, allow a user to place a wager on a game of chance and/or skill Many of these gaming machines are equipped with currency and voucher receipt units, which receive currency and vouchers. When a voucher is inserted into the gaming machine, the gaming machine can be credited for an amount based on the technique described immediately below.

The vouchers are usually equipped with a barcode representing a serial number. The serial number is read and then transmitted, via a computer network, to a server computer remote from the gaming machine. The server computer then verifies that the serial number is valid and determines an amount associated with the serial number. The amount is then transmitted, via the network, back to the gaming machine. The gaming machine then credits the user with the amount, thus allowing the user to play the gaming machine.

Unfortunately, the above technique requires the gaming machine to be connected to the computer server via the computer network. When an entity, such as a gaming machine manufacturer, wishes to provide promotional play on a gaming machine via a voucher, the process typical requires extensive coordination with the casino to properly program the server computer. Moreover, different casinos often employ numerous different server computer systems, such that the entity wishing to provide promotional play must generate numerous different types of vouchers, each type conforming to a different system standard. The subject application addresses these shortcomings and provides other advantages.

SUMMARY OF THE INVENTION AND ADVANTAGES

The subject application includes a method of validation of a voucher in a gaming machine having a controller. The method includes the step of receiving the voucher in the gaming machine from a user. The voucher includes first coded indicia having first identification data and value data representing a value of the voucher. The voucher also includes second coded indicia being generally non-viewable and having second identification data. The method also includes reading the first coded indicia disposed on the voucher and decoding the first coded indicia to determine the first identification data and the value data. The method further includes reading the second coded indicia disposed on the voucher and decoding the second coded indicia to determine the second identification data. An algorithm is executed with the controller using at least one of the first identification data, the second identification data, and the value data to generate algorithm data. The method also includes validating the authenticity of the voucher with the controller using at least the algorithm data to determine if the voucher is authentic. The gaming machine is credited with the value of the voucher in response to the voucher being authentic.

The method provides a secure technique for transferring a value, i.e., playable credits, to the machine without the need for a server computer connected to the gaming machine via a network. As such, the method may be employed by entities wishing to provide a promotion or incentive for gaming machine play without tedious planning and coordination with casinos and gaming machine operators.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 2 is a block diagram of one embodiment of the gaming machine; and

FIG. 3 is a front view of one embodiment of a voucher.

DETAILED DESCRIPTION OF THE INVENTION

Figure 1:
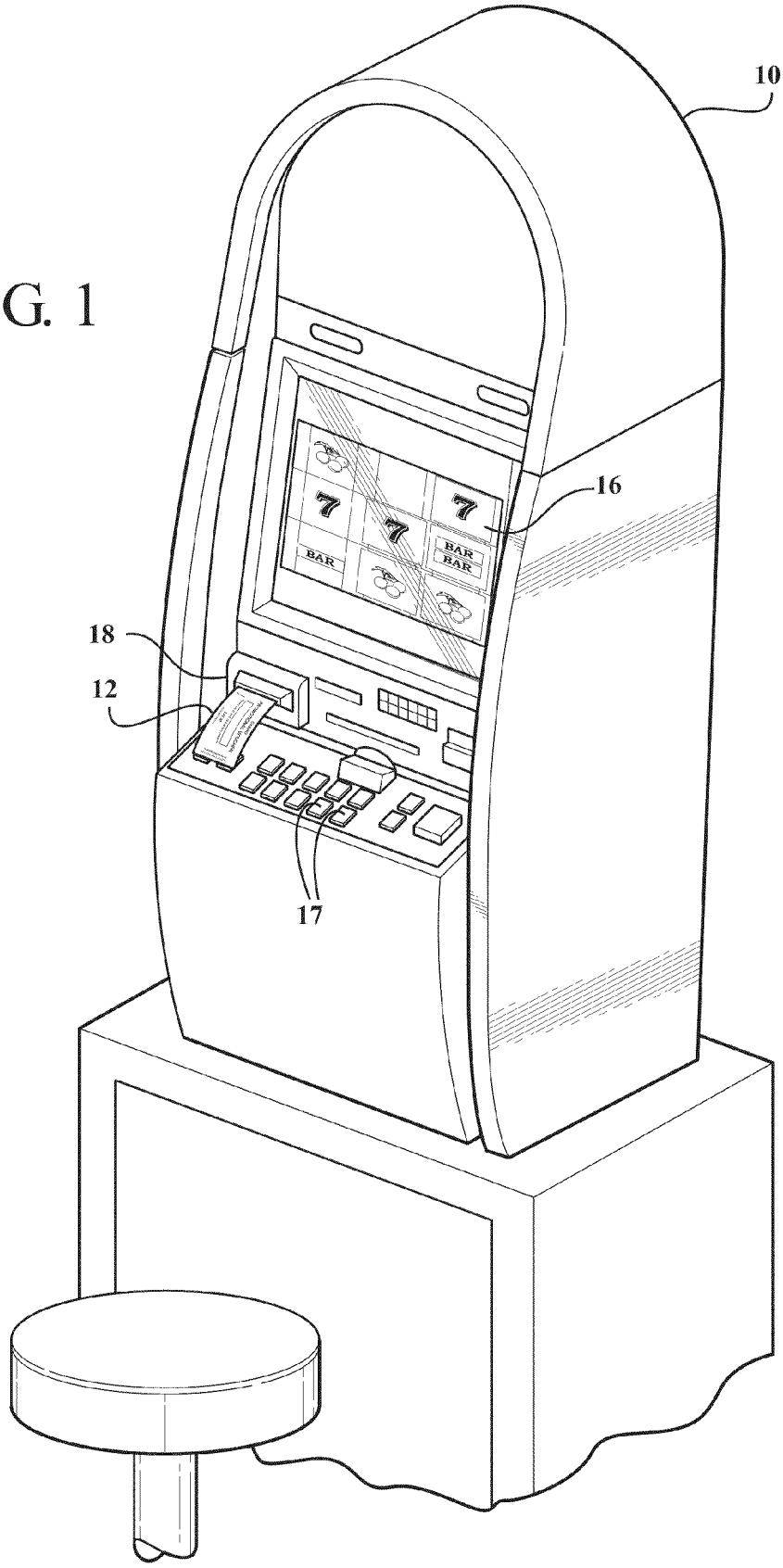
FIG. 1 is a perspective view of one embodiment of a gaming machine.

Referring to the Figures, wherein like numerals indicate like parts throughout the several views, a gaming machine 10 and method of validation of a voucher 12 in the gaming machine 10 is shown herein. The voucher 12 is also commonly referred to as a "ticket" or a "coupon".

Referring to FIG. 1, gaming machines 12, as is well known to those skilled in the art, allow a user to place a wager for the chance at winning a prize or monetary award. That is, the gaming machine may be used for gambling. Gaming machines 12 are often commonly referred to as "slot machines" by those skilled in the art. Of course, gaming machines 12 may be alternatively implemented without the need to receive a monetary value, i.e., for non-wagering, amusement purposes.

The gaming machine 10, as shown in FIG. 2, includes at least one controller 14 for controlling operation of the gaming machine 10. In one embodiment, the controller 14 includes a microprocessor (not separately numbered) capable of storing data, performing mathematical computations, and executing programs. Specifically, the controller 14 includes a credit register 15 for storing one or more values of credits that are playable on the gaming machine 10. The gaming machine 10 of the illustrated embodiment also includes at least one output device 16, such as a display and speakers (not separately numbered), and at least one input device 17, such as a plurality of pushbuttons (not separately numbered).

The gaming machine 10 also includes a voucher receipt unit 18 for receiving the voucher 12 from the user. The voucher 12 is an object used to convey a value. The voucher 12 may also be referred to as a coupon or ticket as known by those skilled in the art. The voucher 12 may comprise paper, plastic, or other material as realized by those skilled in the art. In addition to receiving the voucher 12, the voucher receipt unit 18 may also receive currency, i.e., bills, and/or other tickets from the user for wagering as is well known to those skilled in the art.

Referring now to FIG. 3, the voucher 12 includes first coded indicia 20 and second coded indicia 22. The first coded indicia 20 encodes first identification data and value data. The value data represents a value of the voucher. In the illustrated embodiment, the first coded indicia 20 is implemented as a barcode. However, those skilled in the art realize that the first coded indicia 20 may be implemented in many other forms, including, but not limited to, a magnetic strip, magnetic ink character recognition (MICR), a radio frequency identification (RFID) chip or tag, character printing, and an image.

The first coded indicia 20 may encode other data and/or information, besides the first identification data and the value data. For instance, the first coded indicia 20 may include player identification data representing a unique user. The first coded indicia 20 may also include date/time data representing valid dates and/or times for use of the voucher 12. As such, this date/time data may be used to set a start date and/or time for use of the voucher 12, an expiration date and/or time, or limit use of the voucher 12 to certain days of the week and/or times of the day. Moreover, the first coded indicia 20 may further include casino identification data representing one or more gaming facilities, i.e., casinos. That is, the voucher 12 may only be used in certain gaming establishments. Furthermore, the first coded indicia 20 may include gaming device type data representing a brand of gaming machine, a denomination of gaming machine, and/or a type of gaming machine. Those skilled in the art will realize other data that may be properly encoded by the first coded indicia 20.

The second coded indicia 22 is generally non-viewable with an unaided human eye. That is, the user is not able to easily view or otherwise discern the second coded indicia 22 without specialized equipment or magnification. In one embodiment, the second coded indicia 22 is implemented with invisible ink. Examples of invisible ink are infrared light (IR) absorption inks (i.e., inks that absorb light in the IR wavelengths), ultraviolet (UV) light emission inks (i.e., inks that emit reflect light in the UV wavelengths), and luminescent inks. However, those skilled in the art realize other suitable invisible inks, such as those that fluoresce or those that become visible with application of heat. In another embodiment, the second coded indicia 22 is implemented with one or more invisible threads that are incorporated within the paper stock of the coupon 10.

In the illustrated embodiment, the first and second coded indicia 20, 22 occupy different areas (not numbered) on the voucher 12. However, in other embodiments (not shown), the first and second coded indicia 20, 22 may occupy, at least partially, the same area on the voucher 12. That is, the first and second coded indicia 20, 22 may overlap one another.

The second coded indicia 22 encodes second identification data. The second coded indicia 22, particularly when implemented with invisible ink, may be arranged as a barcode to encode the second identification data. Those skilled in the art realize other techniques to encode the second identification data using the non-viewable second coded indicia 22.

The data encoded by the first and second coded indicia 20, 22 may be encrypted. That is, the information may be transformed into an unreadable or unrecognizable form that must be decoded using an algorithm with a key. Those skilled in the art realize multiple techniques of encryption that may be suitably applied to the data encoded by the first and second coded indicia 20, 22.

The gaming machine 10 includes at least one reading apparatus 24 for reading the coded indicia 20, 22 disposed on the voucher 12. The at least one reading apparatus 24 is operatively connected to the voucher receipt unit 18 for reading vouchers 12 received by the voucher receipt unit 18. The at least one reading apparatus 24 of the illustrated embodiment is integrated with the voucher receipt unit 18. However, the at least one reading apparatus 24 may be separate from the voucher receipt unit 18. Furthermore, the at least one reading apparatus 24 may be capable of reading other media apart from the voucher 12. For example, the at least one reading apparatus 24 is preferably capable of reading and verifying authenticity of currency inserted into the voucher receipt unit 18.

The reading apparatus 24 may be a single device or multiple devices. For example, in one embodiment, one reading apparatus 24 is utilized to read the first coded indicia 20 while another reading apparatus 24 is utilized to read the second coded indicia 22. In another embodiment, a single reading apparatus 24 is utilized to read both the first and second coded indicia 20, 22.

Numerous devices may be utilized to implemented the at least one reading apparatus 24. For example, the at least one reading apparatus may be a currency reader, a barcode scanner, a ticket reader, an RFID reader, a magnetic stripe card reader, and/or a smartcard reader. Of course, other suitable devices may be utilized to implement the at least one reading apparatus 24 as realized by those skilled in the art.

The reading apparatus 24 is in communication with the controller 14 such that data can be communicated from the reading apparatus 24 to the controller 14. The reading apparatus 24 may include its own microprocessor (not shown) for performing calculations, in addition to the microprocessor of the controller 14.

The reading apparatus 24 may include a plurality of feed wheels (not shown) for pulling the voucher 12 into the gaming machine 10. Alternatively, the reading apparatus 24 may simply allow a user to slide or swipe the voucher 12 therethrough, thus allowing the reading apparatus 24 to read the indicia 20, 22.

The method of validation of the voucher 12 includes the step of receiving the voucher 12 in the gaming machine 10 from a user. More specifically, in the illustrated embodiment, the voucher 12 is received by the reading apparatus 24.

After received, the method proceeds with the step of reading the first coded indicia 20 disposed on the voucher 12. In the gaming machine 10 of the illustrated embodiment, this step is performed by the at least one reading apparatus 24. In the case where the first coded indicia 20 is a barcode, the barcode is scanned, and the data represented by the barcode is decoded.

In response to the first coded indicia 20 being read, the method further includes decoding the first coded indicia 20 to determine the first identification data and the value data. The decoding of the first coded indicia 20 and the determining of the data may be performed by the reading apparatus 24. Alternatively, the decoding of the first coded indicia 20 and/or the determination of the data may be performed in the controller 14 of the gaming machine 10.

The method further includes the step of reading the second coded indicia 22 disposed on the voucher 12. In the gaming machine 10 of the illustrated embodiment, this step is performed by the at least one reading apparatus 24. In the case where the second coded indicia 22 is optical ink, the optical ink is imaged, and the data represented by the optical ink is decoded.

In response to the second coded indicia 22 being read, the method further includes decoding the second coded indicia 22 to determine the second identification data. The decoding of the second coded indicia 22 and the determining of the data may be performed by the reading apparatus 24. Alternatively, the decoding of the second coded indicia 22 and/or the determination of the data may be performed in the controller 14 of the gaming machine 10.

The method further includes the step of executing an algorithm using at least one of the first identification data, the second identification data, and the value data to generate algorithm data. In the illustrated embodiment, the controller 14 executes the algorithm, i.e., the controller 14 run a program to perform the mathematical function of the algorithm.

The algorithm may be one of many possible mathematical formulas. For example, the algorithm data may be solved using addition (e.g., ID1+ID2+V=A), multiplication (ID1*ID2*V=A), subtraction, multiplication, etc., and/or a combination of techniques, as will be evident to those skilled in the art.

The method also includes the step of validating the authenticity of the voucher 12 using at least the algorithm data to determine if the voucher 12 is authentic. In the illustrated embodiment, the controller 14 performs the validation.

In one embodiment, the step of executing the algorithm is accomplished using the first identification data and the value data to generate the algorithm data. As just one example, the first identification data may be multiplied by the value data, then added to the value data, to produce the algorithm data (ID1*V+V=A). Validating the authenticity of the voucher 12 is then accomplished by comparing the algorithm data to the second identification data. The voucher 12 is determined to be authentic if the algorithm data and the second identification data are equal to one another. In another example, a public-private key cryptographic technique is used where the first identification data and the value data are passed through a hashing function to produce a digital signature. Encrypting the digital signature with one of the keys in the public-private key pair results in the second identification data. Validation is performed by comparing the decrypted second identification data with the hashed first identification data. The voucher 12 is authentic and unaltered when the two values are the same.

In another embodiment, the step of executing the algorithm is accomplished using the first identification data and the second identification data to generate the algorithm data. As just one example, the first identification data may be multiplied by a factor of 3, then divided by the second identification data, to produce the algorithm data (ID1*3/ID2=A). Validating the authenticity of the voucher 12 is then accomplished by comparing the algorithm data to a predetermined value stored in the controller 14. The voucher 12 is determined to be authentic if the algorithm data and the predetermined value are equal to one another.

If the voucher 12 is determined to be authentic, the method continues with the step of crediting the gaming machine 10 with the value of the voucher 12. Accordingly, the user may then play the machine 10 using the value credited from the voucher 12. The value credited to the machine 10 may be cashable or non-cashable, depending on the data encoded on the voucher 12. Said another way, the value may be immediately redeemed for cash, i.e., cashable, or may only be used to play the game presented on the gaming machine 10, i.e., non-cashable. Similarly, the value credited may be transferable or non-transferable to another game, another player, another property, etc.

The method thus provides a secure technique for transferring a value, i.e., playable credits, to the gaming machine 12 without the need for a server computer (not shown) connected to the gaming machine 12 via a network (not shown). As such, the method may be employed by entities wishing to provide a promotion or incentive for play of the gaming machine 12 without tedious planning and coordination with casinos and/or gambling facilities.

After the voucher is determined to be authentic, the method of the illustrated embodiment includes the step of retaining the voucher 12 in the gaming machine 10. As such, the user may not reuse the voucher 12 at another machine 10. Furthermore, the voucher 12 is preferably collected and returned to an issuer. The issuer can then reimburse the casino or other owner of the gaming machine 10 for the value credited to the gaming machine 10 from the voucher.

In the illustrated embodiment, the voucher 12 is returned to the user if the voucher 12 is not determined to be authentic. As such, the user may return the voucher 12 to the issuer for a replacement. In other embodiments, the voucher 12 may be retained within the gaming machine 10, particularly if the voucher 12 is found to be counterfeit.

Despite not needing to be connected to the server, the gaming machine 10 may be connected to a network, and a server computer, for other purposes besides voucher 12 validation. For instance, the gaming machine 10 may require connection for ticket validation and/or recording game play by the user. However, connection to the network and/or server need not interfere with operation of the method described herein.

The present invention has been described herein in an illustrative manner, and it is to be understood that the terminology which has been used is intended to be in the nature of words of description rather than of limitation. Obviously, many modifications and variations of the invention are possible in light of the above teachings. The invention may be practiced otherwise than as specifically described within the scope of the appended claims.

What is claimed is:

1. A method of validation of a voucher in a gaming machine, said method comprising the steps of:

receiving the voucher in the gaming machine from a user wherein the voucher includes first coded indicia having first identification data and value data representing a value of the voucher and second coded indicia having second identification data;

reading the first coded indicia disposed on the voucher;

decoding the first coded indicia to determine the first identification data and the value data;

reading the second coded indicia disposed on the voucher;

decoding the second coded indicia to determine the second identification data;

executing an algorithm with the gaming machine using operands consisting of the first identification data and the value data to generate algorithm data;

validating the authenticity of the voucher with the gaming machine using operands consisting of the algorithm data and the second identification data; and crediting the gaming machine with the value of the voucher in response to the voucher being authentic, whereby the validation of the voucher and the transfer of value of the voucher to the gaming machine is performed by the gaming machine.

2. A method as set forth in claim 1 wherein said step of validating the authenticity of the voucher is further defined as comparing the algorithm data to a predetermined value stored in the gaming machine and determining the voucher is authentic in response to the algorithm data and the predetermined value being equal to one another.

3. A method as set forth in claim 1 wherein the first coded indicia is further defined as a barcode and said step of decoding the first coded indicia is further defined as decoding the barcode to determine the first identification data and the value data.

4. A method as set forth in claim 1 further comprising the step of retaining the voucher in the gaming machine in response to the voucher not being authentic.

5. A method as set forth in claim 1 further comprising the step of returning the voucher to the user in response to the algorithm value not equaling the predetermined value.

6. A method as set forth in claim 1 wherein the first coded indicia further includes a player identification data representing a unique user.

7. A method as set forth in claim 1 wherein the first coded indicia further includes date/time data representing at least one of valid dates and valid times for use of the voucher.

8. A method as set forth in claim 1 wherein the first coded indicia further includes casino identification data representing one or more gaming facilities.

9. A method as set forth in claim 1 wherein the first coded indicia further includes gaming device type data representing at least one of a brand of gaming machine, a denomination of gaming machine, and a type of gaming machine.

10. A method as set forth in claim 1 wherein the value credited to the gaming machine is of a non-cashable type.

11. A method as set forth in claim 1 wherein the value credited to the gaming machine is of a non-transferrable type.

12. A method of validation of a voucher in a gaming machine, said method comprising the steps of:

receiving the voucher in the gaming machine from a user wherein the voucher includes first coded indicia having first identification data and value data representing a value of the voucher and second coded indicia having second identification data;

reading the first coded indicia disposed on the voucher;

decoding the first coded indicia to determine the first identification data and the value data;

reading the second coded indicia disposed on the voucher;

decoding the second coded indicia to determine the second identification data;

executing an algorithm with the gaming machine using operands consisting of the first identification data and the value data to generate algorithm data;

validating the authenticity of the voucher in the gaming machine using at least the algorithm data to determine if the voucher is authentic; and crediting the gaming machine with the value of the voucher in response to the voucher being authentic wherein said step of validating the authenticity of the voucher is further defined as comparing the algorithm data to the second identification data and determining the voucher is authentic in response to the algorithm data and the second identification data being equal to one another, whereby the validation of the voucher and the transfer of value of the voucher to the gaming machine is performed in the gaming machine.

13. A gaming machine comprising:

a credit register configured to store a value of playable credits;

a voucher receipt unit configured to receive a voucher, the voucher including:

first coded indicia having first identification data and value data representing a value of the voucher; and second coded indicia having second identification data representing at least one of the first identification data and the value data;

at least one reading apparatus configured to read the first coded indicia and the second coded indicia disposed on the voucher;

a gaming machine controller positioned within the gaming machine and configured to:

decode the first coded indicia to determine first identification data and value data;

decode the second coded indicia to determine second identification data;

execute an algorithm using operands consisting of the first identification data and the value data to generate algorithm data;

validate the authenticity of the voucher using operands consisting of the algorithm data and the second identification data to determine if the voucher is authentic, and credit the credit register with the value of the voucher in response to the voucher being authentic, whereby the validation of the voucher and the transfer of value of the voucher to the gaming machine is performed by the gaming machine controller.

14. A gaming machine as set forth in claim 13 wherein said at least one reading apparatus is further defined as barcode scanner.

15. A gaming machine as set forth in claim 13 wherein said at least one reading apparatus is further defined as an optical scanner.

* * * * *